US005969437A

United States Patent [19]

Foerster

[11] Patent Number: 5,969,437

[45] Date of Patent: Oct. 19, 1999

[54] DUAL POWERED, SMOKE DETECTOR ACTIVATED FLASHLIGHT

[75] Inventor: Roy Foerster, Thousand Oaks, Calif.

[73] Assignee: Kalidon Technology, Inc., Camarillo, Calif.

[21] Appl. No.: 08/991,481

[22] Filed: Dec. 16, 1997

[51] Int. Cl.[6] ..... G08B 17/10

[52] U.S. Cl. ..... 307/66; 307/64; 340/321; 340/628; 315/86

[58] Field of Search ..... 307/66, 64; 340/628, 340/333, 529, 527, 521, 586, 636, 321, 540; 315/86

[56] References Cited

U.S. PATENT DOCUMENTS

| | | | |
|---|---|---|---|
| 3,893,081 | 7/1975 | Hopkins | 340/148 |
| 4,001,803 | 1/1977 | Lombardo | 340/248 B |
| 4,001,805 | 1/1977 | Golbe | 340/280 |
| 4,257,039 | 3/1981 | Webb et al. | 340/629 |
| 4,300,133 | 11/1981 | Solomon | 340/630 |
| 4,305,069 | 12/1981 | Machen et al. | 340/628 |
| 4,380,760 | 4/1983 | Kornblit | 340/333 |
| 4,419,658 | 12/1983 | Jarosz et al. | 340/521 |
| 4,432,041 | 2/1984 | Pfisterer et al. | 362/86 |
| 4,467,263 | 8/1984 | Conforti et al. | 320/2 |
| 4,617,561 | 10/1986 | Brown | 340/628 |
| 4,763,115 | 8/1988 | Cota | 340/628 |
| 4,914,555 | 4/1990 | Gammache | 362/183 |
| 4,977,351 | 12/1990 | Bavaro et al. | 307/66 |
| 5,077,643 | 12/1991 | Leach | 362/183 |
| 5,574,436 | 11/1996 | Sisselman et al. | 340/628 |

*Primary Examiner*—Albert W. Paladini
*Attorney, Agent, or Firm*—Leydig, Voit & Mayer, Ltd.

[57] ABSTRACT

A dual powered flashlight responsive to an audible smoke detector alarm includes a sound sensor for sensing an audible smoke detector alarm and producing an electrical alarm signal in response; a frequency-sensitive amplifier amplifying the electrical alarm signal but not other signals; an integrator for integrating the electrical alarm signal amplified by the frequency-sensitive amplifier and for generating a trigger signal only when the integrated signal exceeds a threshold; a lamp; a battery connector for receiving a battery for providing current for illuminating the lamp; a power supply including a mains connector connectable to electrical power lines and powering the frequency-sensitive amplifier and the integrator; and a switch receiving the trigger signal and a power supply signal from the power supply for connecting the lamp to the battery in response to at least one of a trigger signal and absence of application of electrical power to the mains connector. The flashlight illuminates automatically in the event of a power failure or generation of a smoke detector alarm and remains illuminated so long as the power failure or alarm continues or upon unplugging from the power lines to aid in escape from smoke or a power failure.

20 Claims, 3 Drawing Sheets

DUAL POWERED, SMOKE DETECTOR ACTIVATED FLASHLIGHT

FIELD OF THE INVENTION

The present invention relates to a flashlight illuminated by a battery and connectable to electrical power lines, the flashlight being illuminated by current flowing from the battery in response to failure of electrical power or emission of an audible alarm by a smoke detector.

BACKGROUND OF THE INVENTION

The invention provides a flashlight activated in response to a power failure or an alarm produced by a smoke detector so that a person in a dark and/or smoke-filled or smoke-filling room can use the light to escape. Flashlights activated by an audible smoke detector alarm are known. For example, U.S. Pat. No. 4,432,041 describes a flashlight powered entirely by internal batteries and retained by a holster mounted on a wall. The flashlight responds to a smoke detector alarm by turning on the light. The flashlight includes a spring activated switch. When the flashlight is withdrawn from the holster, a retaining force on a plug within the flashlight is released so the plug is ejected, closing a switch, and the flashlight remains illuminated. In the absence of removal of the flashlight from the holster, the light is extinguished automatically after a delay following termination of the smoke detector alarm. The lamp of this flashlight and the alarm detection circuitry of this flashlight are powered solely by internal batteries that are gradually consumed in operating the audible alarm detector while listening for a smoke detector alarm. Therefore, the flashlight described in U.S. Pat. No. 4,432,041 includes a low voltage detector for warning the user that the batteries have declined sufficiently in power to require replacement.

It is desirable in a flashlight activated by an audible smoke detector alarm to provide a long-life power source. Preferably, batteries are employed so that the flashlight is portable. To extend the lifetime of the batteries to the shelf life of the batteries, it is desired that the batteries not be drained during times when the flashlight is not illuminated.

SUMMARY OF THE INVENTION

It is an object of the invention to provide a flashlight activated by an audible smoke detector alarm and powered by a battery.

It is a further object of the invention to provide a flashlight activated by an audible smoke detector alarm powered, at least when the flashlight is not illuminated, by electrical power supplied by conventional main power lines.

It is another object of the invention to provide a flashlight activated by an audible smoke detector alarm that illuminates when electrical power is not supplied to the flashlight through conventional main power lines.

The objects of the invention are achieved in a dual powered smoke alarm activated flashlight including a battery for powering a lamp, with the battery connected to the light through a normally closed switch. The flashlight is connectable to the main power lines (mains) and electrical power from the mains keeps the normally closed switch open. Upon failure of the power, the switch is closed and the lamp is illuminated by the battery. In addition, the flashlight includes a microphone and a frequency-sensitive amplifier amplifying only a signal received by the microphone that is characteristic of a smoke detector alarm. The amplified signal is supplied to an integrator that ensures that the flashlight is not activated unless the smoke detector alarm is sustained for a sufficient period of time, thereby further rejecting noise. The integrator is connected to the normally closed switch and causes the switch to be closed, even when electrical power is supplied by the mains, thereby illuminating the light with power supplied from the battery in response to an alarm. Disconnection of the flashlight from the mains ensures a continuation of lamp illumination. Further, the lamp remains illuminated as long as the smoke detector alarm continues sounding and for a fixed period, having a duration determined by a timer, after the alarm stops.

According to one aspect of the invention, a dual powered flashlight responsive to an audible smoke detector alarm includes a sound sensor for sensing an audible smoke detector alarm and producing an electrical alarm signal in response, a frequency-sensitive amplifier receiving the electrical alarm signal and amplifying the electrical alarm signal but not other signals produced by the sound sensor, an integrator receiving the electrical alarm signal from the frequency-sensitive amplifier for integrating the electrical alarm signal amplified by the frequency-sensitive amplifier to produce an integrated signal and for generating a trigger signal only with the integrated signal exceeds a threshold, a lamp, a battery connector for receiving a battery for providing current for illuminating the lamp, a power supply including a mains connector connectable to electrical power lines and powering the frequency-sensitive amplifier and the integrator, and a switch for receiving the trigger signal and a power supply signal from the power supply for connecting the lamp to the battery in response to at least one of a trigger signal and absence of application of electrical power to the mains connector.

According to a further aspect of the invention, the integrator includes a timer for continuing generation of the trigger signal for a fixed length period following termination of an audible smoke detector alarm.

According to another aspect of the invention, the switch is normally closed and is opened while electrical power is applied to the mains connector unless a trigger signal is generated by the integrator.

In another feature of the invention, the integrator includes a charge pump and differential amplifier for establishing the threshold at which the integrated alarm signal causes a trigger signal to be generated.

In still another feature of the invention, the power supply includes a battery charging circuit for charging the battery when the power supply is connected to the electrical power lines and electrical power is present on the power lines.

According to yet another aspect of the invention, a dual powered flashlight responsive to an audible smoke detector alarm includes a sound sensor for sensing an audible smoke detector alarm and producing an electrical alarm signal in response, a frequency-sensitive amplifier receiving the electrical alarm signal and amplifying the electrical alarm signal but not other signals produced by the sound sensor, an integrator receiving the electrical alarm signal from the frequency-sensitive amplifier for integrating the electrical alarm signal amplified by the frequency-sensitive amplifier to produce an integrated signal and for generating a trigger signal only with the integrated signal exceeds a threshold, a lamp, a battery connector for receiving a battery for providing current for illuminating the lamp, a power supply including a mains connector connectable to electrical power lines and powering the frequency-sensitive amplifier and the integrator, and a normally closed switch connecting the lamp to the battery when the normally closed switch is closed, the normally closed switch being opened when the mains connector is supplied with electrical power unless a trigger signal is applied to the normally closed switch by the integrator.

DETAILED DESCRIPTION OF PREFERRED EMBODIMENTS

Figure 1:
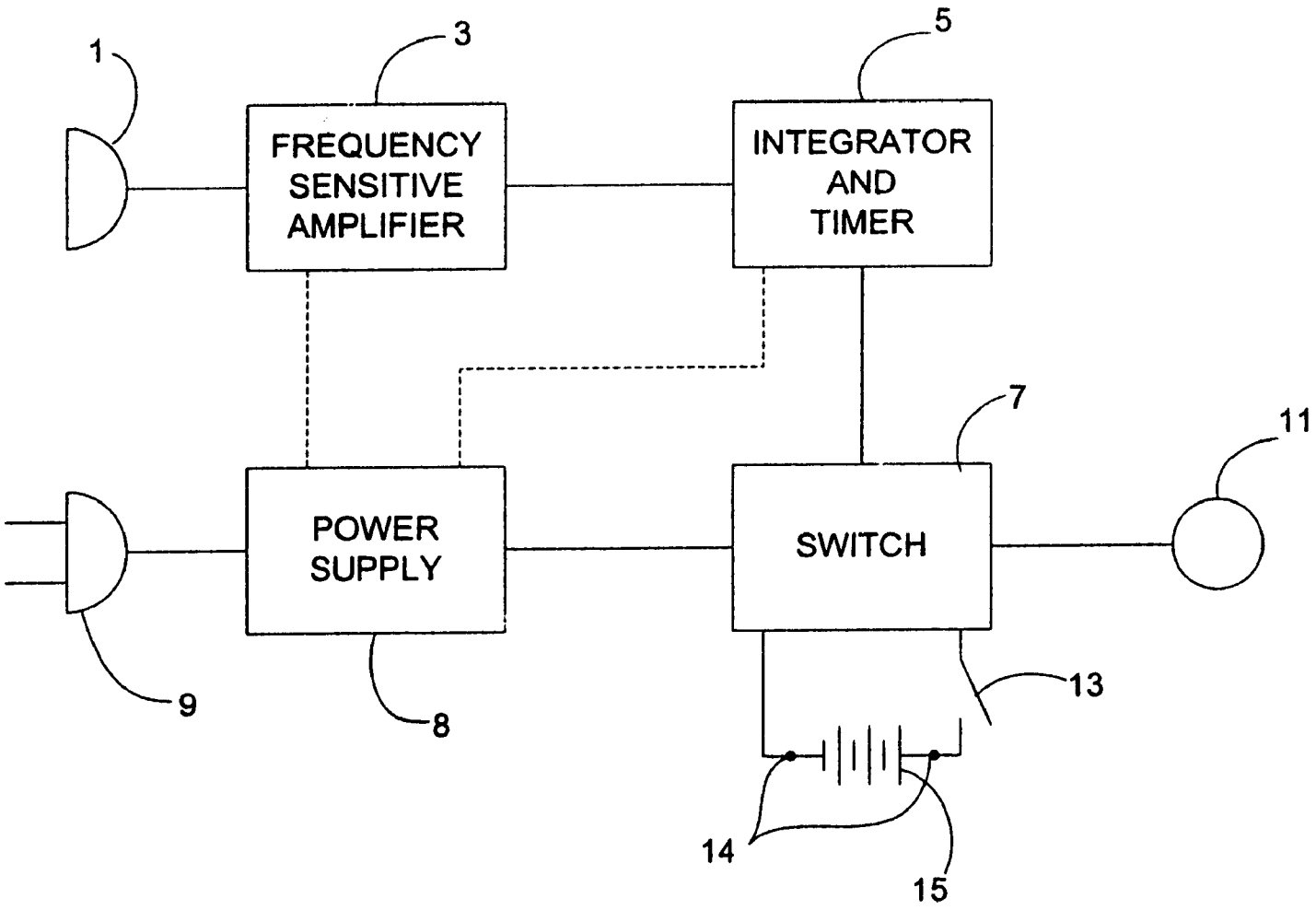
FIG. 1 is a block diagram of a flashlight according to an embodiment of the invention.

FIG. 1 is a functional block diagram of a battery powered flashlight responsive to an audible smoke detector alarm according to the invention. The flashlight includes a microphone 1 as a sound sensor for sensing an audible smoke detector alarm. The microphone may be any small, relatively sensitive, preferably omnidirectional, microphone. For example, the microphone may be an electret microphone. Most smoke detectors produce a pulsing tone at about 3.2 kHz. Most preferably, the microphone 1 is mounted within a resonant chamber resonating at or near the frequency of the audible smoke detector alarm. The resonant chamber effectively amplifies the smoke detector alarm by damping extraneous sounds.

The microphone 1 is connected to a frequency-sensitive amplifier 3. The frequency-sensitive amplifier has a bandpass characteristic so that the sound of an audible smoke detector alarm is amplified selectively, i.e., electrical signals produced by the microphone 1 and not corresponding to an alarm signal are not amplified or are amplified much less than is an electrical alarm signal produced in response to a smoke detector alarm. Preferably, the frequency-sensitive amplifier employs active networks including operational amplifiers as bandpass amplifiers to achieve high gain and stable performance. As an example, the bandwidth of the bandpass amplifiers may be about 600 Hz with a rejection of signals outside the pass band of 45 dB. This selective amplification is important to prevent identification of loud music or other loud sounds as a smoke detector alarm.

The amplified electrical alarm signal produced by the frequency-sensitive amplifier 3 is supplied to an integrator and timer 5. In general, the audible smoke detector alarm signal is a pulsating signal that is occasionally intermittent. To be effective, the flashlight unit must recognize the frequency of the smoke detector alarm but ignore the intermittent nature of that signal. This result is achieved by integrating the amplified alarm signal over time. A false alarm or an alarm of insufficient duration fails to integrate to a threshold established in the integrator and timer 5 and, therefore, fails to actuate the flashlight. On the other hand, when the amplified alarm signal continues for sufficient duration, including intermittent periods, then the threshold is exceeded so that a trigger signal is generated by the integrator and timer 5 and supplied to a switch 7.

The integrator and timer 5 also includes a timer function to ensure that a trigger signal continues to be supplied, for a period of fixed duration, after the amplified alarm signal is no longer supplied by the frequency-sensitive amplifier 3 to the integrator and timer 5. As explained below, this continuing signal ensures that the flashlight remains illuminated for a minimum period of time after generation of a trigger signal so that the flashlight can be located, if necessary, even if the smoke detector alarm stops. The light is extinguished after expiration of the period of fixed duration, unless the flashlight is placed into service, so that the battery is not unduly drained.

A power supply 8 includes a mains connector 9 connectable to the conventional AC power supply grid, i.e., a wall outlet supplying 120 volts AC. The power supply 8 produces power for operating circuitry of the flashlight, except for the lamp, so long as electrical power is supplied to the mains connector 9. The power supply 8 also provides a power supply signal to the switch 7.

The switch 7, a switch that is normally closed in the absence of applied stimuli, as described below, is connected to the power supply 8 and the integrator and timer 5. Also connected to the switch 7 are a lamp 11 of the flashlight and, through an on/off switch 13, a battery connector 14 into which a battery 15 is inserted. The battery 15, a conventional non-rechargeable battery in the discussion with respect to the embodiment of FIG. 3, powers the lamp 11 when the on/off switch 13 and the switch 7 are both closed. The battery 15 may be extracted from and installed in the connector 14, typically a built-in battery compartment, for ready battery replacement. The following description presumes that the battery 15 is in place in the connector 14.

In normal operation, the mains connector 9 is connected to an electrical outlet, such as a wall outlet. For example, the flashlight may include protruding prongs that are directly insertable in an electrical outlet. The stimulus provided by the electrical power supply from the mains connector 9 causes the switch 7 to remain open in normal circumstances. Likewise, when no power is supplied to the mains connector 9, regardless of other circumstances, the normally closed switch 7 is closed so that the battery 15 supplies electrical power to and illuminates the light 11. (It is assumed that the on/off switch 13 is closed in this normal operating arrangement.) Further, the switch 7, even if kept open in response to power supplied to the mains connector 9, is also closed in response to the stimulus of a trigger signal generated and supplied by the integrator and timer 5, indicating the detection of an audible smoke detector alarm.

Thus, the battery 15 is connected to and powers the lamp 11 when there is no power supplied to the mains connector 9, either because of a power failure or because the flashlight has been disconnected from the main power lines, and when an audible smoke detector alarm is being detected or has been recently detected, causing generation of a trigger signal. At all other times, when electrical power is supplied through the mains connector 9, that power is employed to operate the frequency-sensitive amplifier 3, the integrator and timer 5, and the switch 7 so that no current is drawn from the battery 15. In other words, the battery supplies current to the lamp 11 only in emergency situations so that maximum battery life is achieved.

The lamp is illuminated whenever the smoke detector alarm sounds, enabling a person to find the light within a room and to use the light to aid in exiting the room which may be filled with or may be filling with smoke. Since, in most residential and commercial locations, power outlets are located relatively close to the floor, the flashlight can be relatively easily located when it is illuminated because smoke usually fills a room from the ceiling downward. Further, in the event of a power failure, with or without the detection of a smoke detector alarm, the light is illuminated to enable a person to take such action as necessary during the power failure.

Figure 2:
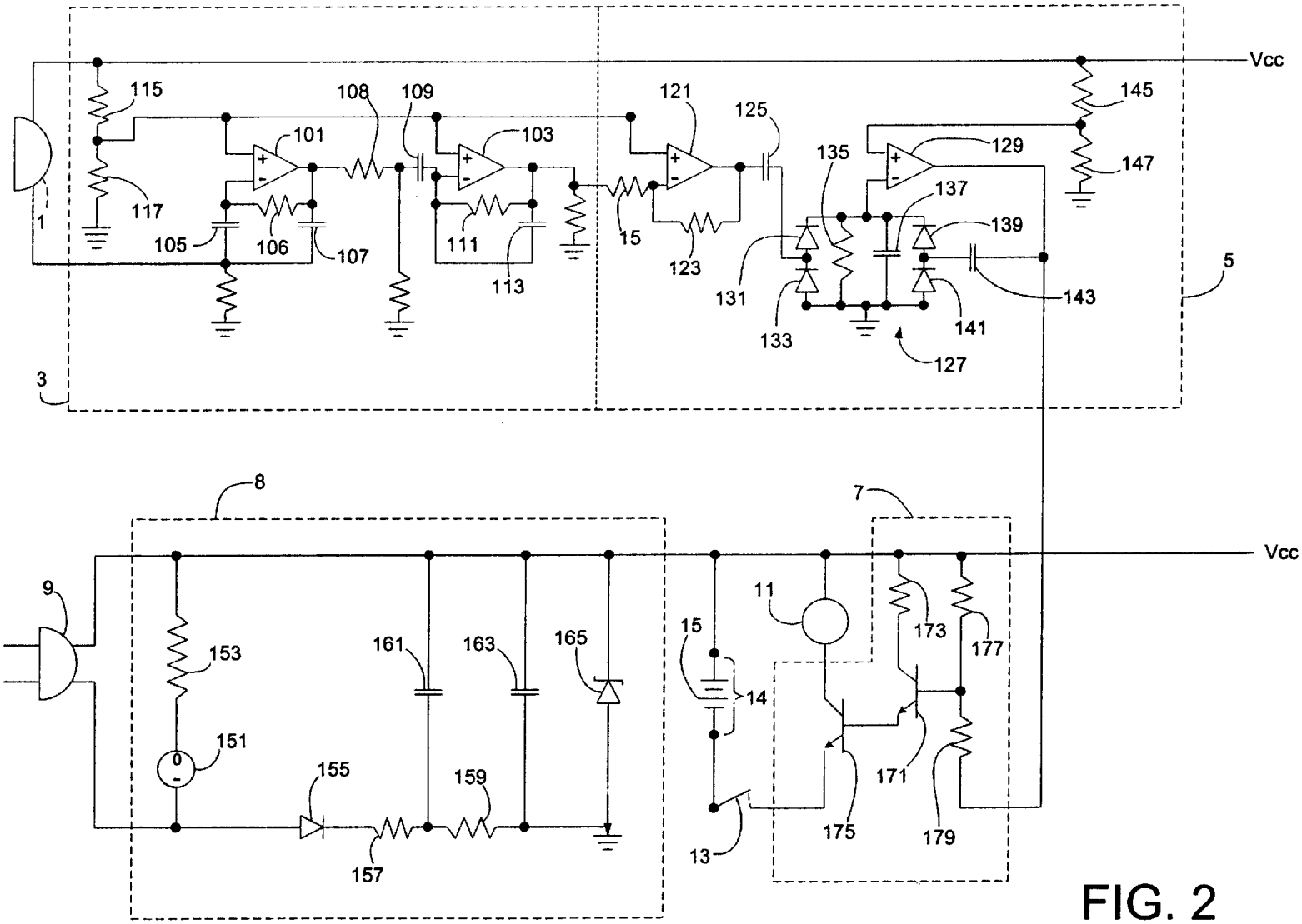
FIG. 2 is a schematic diagram of a flashlight according to an embodiment of the invention.

FIG. 2 is an electrical schematic of circuit of a flashlight according to an embodiment of the invention. Elements forming the functional blocks of FIG. 1 are indicated by dashed lines and are identified by the same numbers used in FIG. 1. The embodiment of FIG. 2 employs four operational amplifiers for several specific functions, as described below. Preferably, those amplifiers and some of the associated components are all part of a common integrated circuit, such as an LM324N. Two of the amplifiers, amplifiers 101 and 103, are part of the frequency-sensitive amplifier 3. That amplifier receives a signal from a sound sensor, the microphone 1. Depending upon the type of microphone employed, the powering voltage of the circuit may be applied across the microphone, as shown in FIG. 2. The two stage bandpass amplifier of FIG. 2 employs resistive and capacitive tuned circuits, free of inductors, to produce the desired bandpass frequency response characteristic.

The output of the microphone 1 is input to the inverting terminal of the first amplifier 101 through a coupling capacitor 105. The amplified output of the amplifier 101 is fed back to the inverting input terminal through a feedback resistor 106, bypassed by a capacitor 107 that is connected in series with the capacitor 105 across the feedback resistor 106. The output of the amplifier 101 is fed to a second stage of tuned amplification, including the amplifier 103, through another RC network, including a series connected coupling resistor 108 and input capacitor 109, to the inverting terminal of the amplifier 103. A feedback resistor 111 is bypassed by a capacitor 113 connected in series with the input capacitor 109 across the feedback resistor 111. The feedback resistor 111 connects the output of the amplifier 103 to its inverting input terminal.

The frequency-sensitive amplifier has a pass band tuned to the conventional frequency of audible smoke detector alarms, about 3.2 kHz, by appropriate choice of the capacitances and resistances of the RC networks connected to the amplifiers 101 and 103. The non-inverting input terminals of the amplifiers 101 and 103 are connected to a fixed potential provided by a voltage divider including series connected resistors 115 and 117 connected between the supply voltage and ground.

The amplified alarm signal from the frequency-sensitive amplifier 3 is supplied to the integrator and timer 5 at the non-inverting input terminal of an amplifier 121 through a coupling resistor 115. A feedback resistor 123 is connected between the output terminal of that amplifier 121 and its non-inverting input terminal. Further, the output signal of the amplifier 121, corresponding to the pulsating, sometimes intermittent, signal of the smoke detector alarm is supplied through a capacitor 125 to a charge pump including an RC and diode network 127 and an amplifier 129.

The amplifier 121 receives the amplified alarm signal at its non-inverting input. The inverting input terminal of the amplifier 121 is connected to a fixed voltage produced by the voltage divider 128 including resistors 115 and 117. That same voltage is supplied to the non-inverting terminals of amplifiers 101 and 103. The feedback resistor 123 connected between the output and the non-inverting input terminal of the amplifier 121 causes the circuitry to act as a zero-crossing detector. Thus, rather than responding to the input signal amplitude of the amplified electrical alarm signal, an amplitude that can vary widely, the low frequency alarm signal is identified by its zero-crossing rate. The zero-crossing detector generates a rectangular pulsed signal that includes a transition at each zero-crossing of the amplified electrical alarm signal. It is this pulsed signal that is fed to the charge pump network 127 through the capacitor 125.

The charge pump includes a network 127 of four legs connected in parallel and functions as an integrating circuit. Thus, even if the amplified alarm signal converted to the pulsed signal is intermittent, the charge pump accumulates the signal over a period of time, for example, one second. Thus, the frequency of the electrical alarm signal is recognized but the intermittent nature of that signal is essentially ignored. Of course, extraneous electrical signals from audible signals other than smoke detector alarms that may reach the microphone 1 are eliminated by the frequency-sensitive amplifier 3 so that the zero-crossings are not obscured.

The output of the zero-crossing detector is applied to the junction of two series connected diodes 131 and 133, a first leg of the network. The anode of the diode 131 is connected directly to the non-inverting input of the amplifier 129. The diodes 131 and 133 are connected in series in common polarity with the cathode of diode 133 connected to ground. A resistor 135 and a capacitor 137 are connected in parallel as second and third legs of the charge pump network. This RC circuit integrates the output signal of the zero-crossing detector. The values of these two components 135 and 137 determine the integration time of the charge pump, preferably about one second. This RC circuit is connected in parallel with the series connected diodes 139 and 141, a fourth leg of the charge pump network. The diodes 139 and 141 are connected in like polarity series. A relatively large capacitance capacitor 143 is connected between the junction of the diodes 139 and 141 and the output terminal of the amplifier 129. The capacitor 143 is used, as described below, as a timer to delay termination of a trigger signal output from the amplifier 129. The length of the delay is principally determined by the capacitance of capacitor 143. The inverting input of the amplifier 129 is connected to a voltage divider including series connected resistors 145 and 147 connected between the power supply voltage and ground. The voltage provided by this divider determines a threshold of the integrator and timer 5.

When the capacitive charge pump network 127 collects, by integration, sufficient energy from the pulsed signal output from the zero-crossing detector, the output of the amplifier 129 changes state, producing a trigger signal. This transition occurs when the signal input to the signal at the non-inverting terminal of the amplifier 129 exceeds the signal supplied to the inverting terminal by the voltage divider including resistors 145 and 147. By setting that voltage with the voltage divider, the threshold at which a trigger signal, the transition signal output from the amplifier 129, is generated is established.

The charge pump circuitry may be referred to as rate generator. In a typical example, the rate generator may output one volt at an input frequency of 2.5 kHz. This output is used to establish the threshold voltage applied to the inverting input terminal of the amplifier 129 and provides further protection against loud, extraneous low frequency noise that might be amplified in the frequency-sensitive amplifier 3 and reach the charge pump network. Those sources of low frequency noise cannot generate a sufficient output voltage by integration in the charge pump network to drive the rate generator over the trigger signal threshold. However, when an amplified electrical alarm signal is of sufficient amplitude and duration, a trigger signal is output from the amplifier 129 and continues to be output as long as the alarm signal continues to be supplied. That trigger signal charges the capacitor 143 to perform the timing function described below as well as sending the trigger signal to the switch 7. The capacitance of capacitor 143 is preferably chosen so that the timing function has a duration of about two minutes.

The switch 7 receives the trigger signal from the integrator and timer 5 as well as a power supply signal from the power supply 8. The power supply 8 includes a mains connector 9 for connecting to a conventional power grid. The specific embodiment of the power supply illustrated in FIG. 2 includes a conventional neon pilot light 151 connected in series with a dropping resistor 153 across the line voltage. The power supplied to switch 7 by the power supply 8 is rectified by a diode 155 and filtered by two RC networks connected in series, comprising resistors 157 and 159 and capacitors 161 and 163. The output voltage from the power supply 8 is regulated by a Zener diode 165. That regulated voltage is, like the trigger signal, supplied to the switch 7.

The switch 7 controls connection of the lamp 11 to the battery 15. The manual on/off switch 13 is interposed between the battery 15 and the lamp 11 and it is assumed, for the purposes of this discussion, that that switch 13 is closed. However, when the flashlight is taken out of service or when light is no longer needed during a power failure, switch 13 can be opened to conserve the battery 15.

The switch 7 connected to the battery 15 is normally closed. The switch 7 includes a first transistor 171 having a collector connected through a biasing resistor 173 to the power supply voltage and the anode of the battery 15. The transistor 171 has an emitter connected to the base of a second transistor 175. The lamp 11 is connected between the collector of the transistor 175 and the power supply voltage. The emitter of the transistor 175 is connected to the cathode of the battery 15. Further, a second biasing resistor 177 of the switch 7 is connected between the power supply line and the base of the first transistor 175. A trigger signal is input through another biasing resistor 179 to the base of the first transistor 171.

The biasing resistors are chosen in value so that the battery 15, in the absence of any input signals, such as a signal from the power supply 8 or a trigger signal, biases the first transistor 171 into a conducting state which, in turn, biases the second transistor 175 into a conducting state so that current is conducted in the loop including the battery 15 and the lamp 11. In other words, the switch 7 is normally closed. When the signal from the power supply 8 is applied through the bias resistor 177 to the base of the transistor 171, the transistor 171 is turned off, i.e., made non-conducting, which results in biasing of the second transistor 175 into a non-conducting state. As a result, the lamp 11 is not illuminated and no current of any consequence is drawn from the battery 15. In other words, as long as the power supply 8 is supplying an output voltage, i.e., as long as electrical power is applied to the mains connector 9, the lamp 11 is not illuminated. On the other hand, whenever the input signal from the power supply 8 stops, lamp 11 becomes and remains illuminated unless the switch 13 is opened.

The magnitude of the trigger signal applied through the biasing resistor 179 is adjusted so that when the trigger signal is generated, even if a signal is supplied by the power supply 8, the trigger signal biases the transistor 171 to conduct, causing conduction of the transistor 175 and illumination of the lamp 11. Illumination of the lamp 11 continues until the trigger signal is removed or sufficiently declines in amplitude as to be overwhelmed by the power supply signal applied to the base of the transistor 171. Even after the trigger signal is no longer generated by the amplifier 129, because of the charge that has been accumulated on the capacitor 143 during generation of the trigger signal, an apparent trigger signal is still supplied to the biasing resistor 179. This continuing trigger signal keeps the switch 7 closed, illuminating the lamp 11 until the charge on the capacitor 143 declines below a level that sustains the conducting state of the transistor 171, assuming the power supply signal is continuously applied. As mentioned above, the capacitance of the capacitor 143 is chosen to ensure that the lamp 11 remains illuminated, once a trigger signal is generated, for a desired period, for example, approximately two minutes.

In practical terms, the flashlight is initially installed with the on/off switch 13 open by connecting the mains connector 9 to a conventional wall outlet. Then, the on/off switch 13 is closed. Lamp 11 remains dark as long as electrical power is supplied to the mains connector 9 and no trigger signal is generated. In the event of a power failure, regardless of whether a trigger signal is generated, the power supply fails to supply a signal to the biasing resistor 177 so that the transistors 171 and 175 conduct, illuminating lamp 11. The lamp 11 is extinguished when power is restored or the switch 13 is opened.

When an audible smoke detector alarm is received by the microphone 1, a trigger signal is ultimately generated, for example, after about a one second delay for integration by the charge pump network 127, and supplied through the bias resistor 179, causing the transistors 171 and 175 to conduct regardless of the supply of power to the mains connector 9. As long as the trigger signal is generated and the switch 13 remains closed, the lamp 11 is illuminated. Even if the audible smoke detector alarm stops so that the trigger signal ends, the capacitor 143 continues the trigger signal, sustaining illumination of the lamp 11 so that a person can find the flashlight in a smoke-filled or smoke-filling room. Then, when the person extracts the flashlight from the wall outlet to use the flashlight to aid in exiting the area, the lamp 11 remains illuminated, even if the audible smoke detector alarm signal stops, no further trigger signal is generated, and the capacitor 143 is completely discharged, because of the failure of the power supply signal upon disconnection of the mains connector 9.

As long as the power supply 8 supplies a biasing signal preventing the lamp 11 from being illuminated, essentially no current is drawn from the battery 15, even for biasing the transistor 171 so that the battery life equals the shelf life of the battery less any power that is consumed during any power failures or upon detection of an audible smoke detector alarm. Thus, provided the battery 15 is replaced after such incidents, to the extent necessary, and/or on a regular schedule, the flashlight according to the invention provides a reliable source of light for exiting an area in the event of a power failure and/or smoke.

Figure 3:
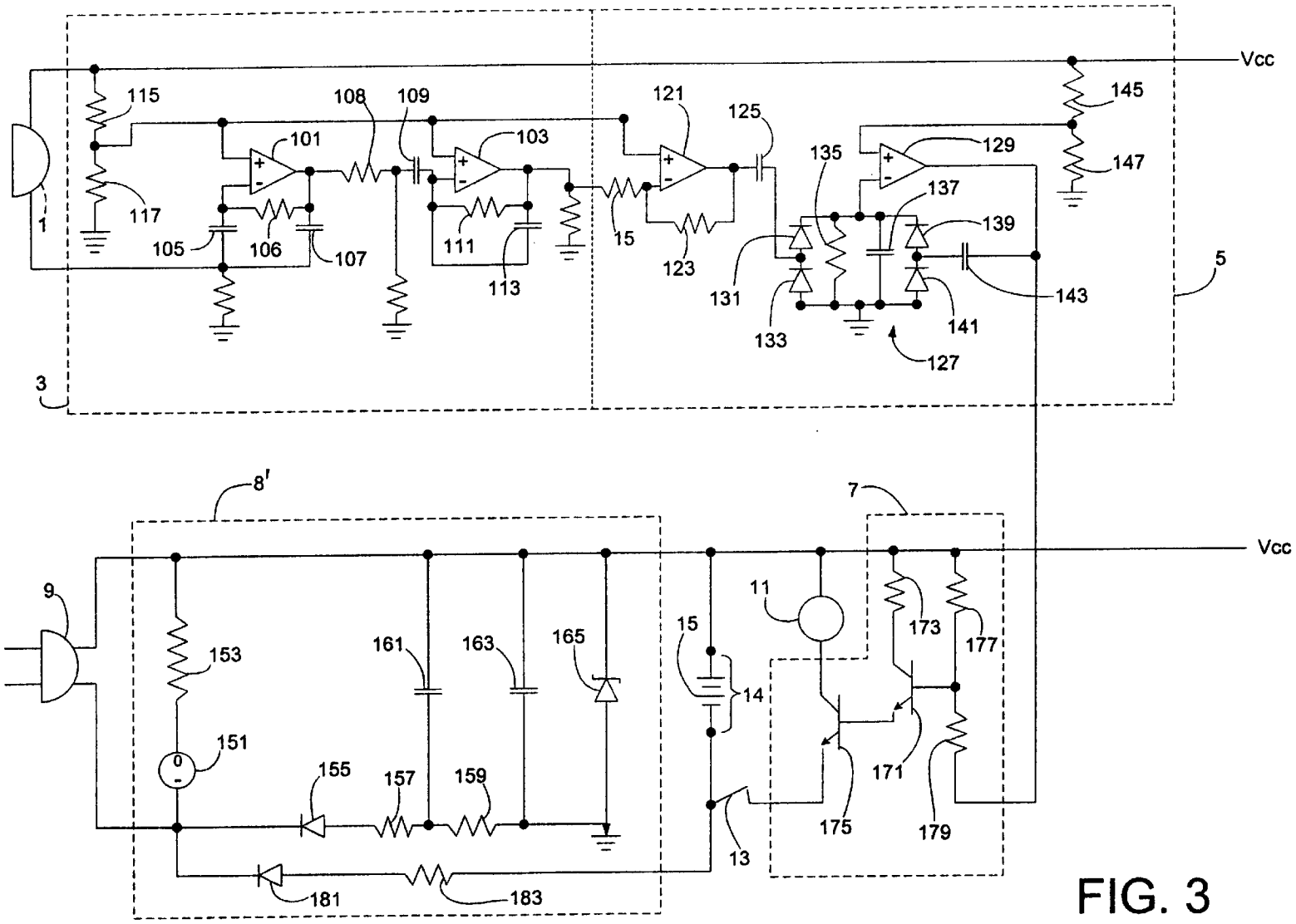
FIG. 3 is a schematic diagram of a flashlight according to an embodiment of the invention.

FIG. 3 is a schematic circuit diagram of an alternative embodiment of the invention. The circuit of FIG. 3 is identical in structure and operation to the embodiment of FIG. 2 except for the following points. The battery 15' is a rechargeable battery rather than the non-rechargeable battery 15 of FIG. 2. The power supply 8' includes a battery charging circuit including a diode 181 and a resistor 183 connected in series between one of the electrical mains and the cathode of the battery 15'. The anode of the battery 15' is connected to the other electrical main. The battery 15' is charged whenever power is applied to the mains connector 9 and the voltage of the battery 15' has fallen low enough so that charging is appropriate. The diode 181 rectifies the charging current and the resistor 183 limits the charging current supplied to the battery 15'.

The rechargeable battery 15' generates a lower voltage than an alkaline cell, but the battery 15' should remain charged and ready for emergency operation at all times without the necessity of routine replacement. The battery current for operating the circuit when the lamp 11 is not illuminated remains minimal.

The invention has been described with respect to certain preferred embodiments. Various modifications and additions will occur to those of skill in the art based upon the foregoing description. Accordingly, the scope of the invention is defined solely by the following claims.

I claim:

1. A dual powered flashlight responsive to an audible smoke detector alarm comprising:

a sound sensor for sensing audible signals, including an audible smoke detector alarm, and producing electrical signals in response, the electrical signals including an electrical alarm signal produced in response to an audible smoke detector alarm;

a frequency-sensitive amplifier receiving the electrical signals and selectively amplifying the electrical alarm signal in the electrical signals produced by the sound sensor;

an integrator receiving the electrical alarm signal from and amplified by the frequency-sensitive amplifier for integrating the electrical alarm signal amplified by the frequency-sensitive amplifier to produce an integrated signal and for generating a trigger signal only when the integrated signal exceeds a threshold;

a lamp;

a battery connector for receiving a battery for providing current for illuminating the lamp;

a power supply including a mains connector connectable to electrical power lines and powering the frequency-sensitive amplifier and the integrator; and a switch receiving the trigger signal and power supply signal from the power supply for connecting the lamp to the battery in response to at least one of a trigger signal and absence of application of electrical power to the mains connector.

2. The dual powered flashlight of claim 1 wherein the frequency-sensitive amplifier comprises a multiple stage bandpass amplifier.

3. The dual powered flashlight of claim 1 wherein the switch is normally closed and is opened when electrical power is applied to the mains connector unless a trigger signal is generated by the integrator, whereby battery life is maximized.

4. The dual powered flashlight of claim 1 wherein the integrator includes a zero-crossing detector for converting the electrical alarm signal amplified by the frequency-sensitive amplifier into a pulsed signal and a charge pump for integrating the pulsed signal.

5. The dual powered flashlight of claim 4 wherein the integrator includes an amplifier, receiving the pulsed signal from the zero-crossing detector, for establishing the threshold at which an electrical alarm signal integrated by the integrator causes a trigger signal to be generated.

6. The dual powered flashlight of claim 1 wherein the power supply includes a battery charging circuit for charging a battery received in the battery connector.

7. The dual powered flashlight of claim 6 wherein the mains connector is connected in parallel with a battery received in the battery connector, through the charging circuit.

8. The dual powered flashlight of claim 1 wherein the integrator includes a timer for continuing generation of the trigger signal for a fixed length period following termination of an audible smoke detector alarm.

9. The dual powered flashlight of claim 8 wherein the integrator includes a charge pump and an amplifier, receiving a signal from the charge pump, for establishing the threshold at which an electrical alarm signal integrated by the integrator causes a trigger signal to be generated.

10. The dual powered flashlight of claim 9 wherein the timer comprises a capacitor connected at a first end to an output terminal of the amplifier and the switch and at a second end to the charge pump.

11. A dual powered flashlight responsive to an audible smoke detector alarm comprising:

a sound sensor for sensing audible signals, including an audible smoke detector alarm, and producing electrical signals in response, the electrical signals including an electrical alarm signal produced in response to an audible smoke detector alarm;

a frequency-sensitive amplifier receiving the electrical signals and selectively amplifying the electrical alarm signal in the electrical signals produced by the sound sensor;

an integrator receiving the electrical alarm signal from and amplified by the frequency-sensitive amplifier for integrating the electrical alarm signal amplified by the frequency-sensitive amplifier to produce an integrated signal and for generating a trigger signal only when the integrated signal exceeds a threshold;

a lamp;

a battery connector for receiving a battery for providing current for illuminating the lamp;

a power supply including a mains connector connectable to electrical power lines and powering the frequency-sensitive amplifier and the integrator; and a normally closed switch connecting the lamp to the battery when the normally closed switch is closed, the normally closed switch being opened while the mains connector is supplied with electrical power unless a trigger signal is applied to the normally closed switch by the integrator, whereby battery life is maximized.

12. The dual powered flashlight of claim 11 wherein the frequency-sensitive amplifier comprises a multiple stage bandpass amplifier.

13. The dual powered flashlight of claim 11 including an on/off switch for electrically connecting and disconnecting the lamp and the battery.

14. The dual powered flashlight of claim 11 wherein the power supply includes a battery charging circuit for charging a battery received in the battery connector.

15. The dual powered flashlight of claim 14 wherein the mains connector is connected in parallel with a battery received in the battery connector, through the charging circuit.

16. The dual powered flashlight of claim 11 wherein the integrator includes a zero-crossing detector for converting the electrical alarm signal amplified by the frequency-sensitive amplifier into a pulsed signal and a charge pump for integrating the pulsed signal.

17. The dual powered flashlight of claim 16 wherein the integrator includes an amplifier, receiving the pulsed signal from the zero-crossing detector, for establishing the threshold at which an electrical alarm signal integrated by the integrator causes a trigger signal to be generated.

18. The dual powered flashlight of claim 11 wherein the integrator includes a timer for continuing generation of the trigger signal for a fixed length period following termination of an audible smoke detector alarm.

19. The dual powered flashlight of claim 18 wherein the integrator includes a charge pump and an amplifier, receiving a signal from the charge pump, for establishing the threshold at which an electrical alarm signal integrated by the integrator causes a trigger signal to be generated.

20. The dual powered flashlight of claim 19 wherein the timer comprises a capacitor connected at a first end to an output terminal of the amplifier and the switch and at a second end to the charge pump.

* * * * *